US006964066B2

(12) United States Patent
Tucker

(10) Patent No.: US 6,964,066 B2
(45) Date of Patent: Nov. 15, 2005

(54) STRETCHABLE, SIZE-ADAPTABLE FABRIC HELMET INSERT WITH SHOCK-ABSORBING STRUCTURE

(75) Inventor: Michael W. Tucker, Vancouver, WA (US)

(73) Assignee: MJD Innovations, LLC, Scappoose, OR (US)

( * ) Notice: Subject to any disclaimer, the term of this patent is extended or adjusted under 35 U.S.C. 154(b) by 0 days.

(21) Appl. No.: 10/792,437

(22) Filed: Mar. 2, 2004

(65) Prior Publication Data

US 2004/0199981 A1 Oct. 14, 2004

Related U.S. Application Data

(60) Provisional application No. 60/461,545, filed on Apr. 8, 2003.

(51) Int. Cl.[7] ..... A42B 3/00
(52) U.S. Cl. ..... 2/414; 2/418; 2/419
(58) Field of Search ..... 2/414, 6.6, 411, 2/415, 416, 417, 418, 419, 420, 5, 909

(56) References Cited

U.S. PATENT DOCUMENTS 3,208,080 A * 9/1965 Hirsch ..... 2/414
5,337,420 A * 8/1994 Haysom et al. ..... 2/410
6,159,324 A * 12/2000 Watters et al. ..... 156/242
6,240,571 B1 * 6/2001 Infusino ..... 2/414
6,493,881 B1 * 12/2002 Picotte ..... 2/413
6,675,395 B1 * 1/2004 Abraham ..... 2/425
6,681,409 B2 * 1/2004 Dennis et al. ..... 2/416
2004/0107482 A1 * 6/2004 Picotte ..... 2/411

* cited by examiner

*Primary Examiner*—Rodney M. Lindsey
(74) *Attorney, Agent, or Firm*—Jon M. Dickinson PC; Robert D. Varitz PC

(57) ABSTRACT

A stretchable-adjustable, cushioning helmet insert employable in the hollow, domed interior of a helmet shell. The insert includes a generally domed cap formed of a reversibly stretchable fabric, and adapted for installation within the interior such a shell, and cushioning structure in the form of plural, spaced cushioning pads positionally affixed to the inside of the cap in a manner whereby expansion and contraction of the cap causes spatial retreat and closure, respectively, of the spacings existing between each pad and its neighboring pads. This insert accommodates proper-fit the "insertion", into a single-size helmet shell, of the different "effective" head sizes associated with a single user, such as a firefighter, who may, at certain times, be wearing no other headgear, and at other times, may be wearing auxiliary (and somewhat bulky) head-borne equipment, such as an oxygen mask.

3 Claims, 1 Drawing Sheet

STRETCHABLE, SIZE-ADAPTABLE FABRIC HELMET INSERT WITH SHOCK-ABSORBING STRUCTURE

CROSS-REFERENCE TO RELATED APPLICATION

This application claims priority to the filing date of U.S. Provisional Patent Application, Ser. No. 60/461,545, filed Apr. 8, 2003, now abandoned, for "Stretchable, Size-Adaptable Fabric Helmet Insert with Shock-Absorbing Structure". The inventorship in that case is identical to the inventorship in the present case. The entirety of that prior-filed patent application is hereby incorporated herein by reference.

BACKGROUND AND SUMMARY OF THE INVENTION

The present invention relates to size-adaptable safety headgear, and more specifically to a novel, size-adaptable, safety-cushioning insert for employment inside the shell of a helmet. This insert is also referred to herein as a size-self-adjustable insert. For purposes of illustration herein, a preferred embodiment of the invention is disclosed in the setting of a military fire-fighting helmet, such as a Navy Firedome FXA-1 helmet made by the Bullard Company of Cynthiana, Ky., with respect to which the invention has been found to offer particular utility.

In recent years, there has been much activity in the development of various kinds of safety gear, and high on the list for attention in that activity has been a focus on new, more versatile, and more protective headgear. The present invention addresses this headgear focus by proposing a novel, simple, size-adaptive and extremely cushioning-effective insert which is to be installed and used inside the shell of a helmet, such as inside the shell (and within the usual conventional internal suspension structure) of a military fire-fighting helmet, wherein the matter of size-adaptability often has certain special importance.

A military fire-fighter may be called upon, at different times, wearing a protective helmet, to engage in fire fighting either (a) with, or (b) without a special support breathing mask, such as an oxygen mask. Such a fire-fighter must be prepared, at a moment's notice, to don one or both of these pieces of equipment, and does not typically have the "luxuries" either of owning two differently-sized helmets suited to this instant need to mount the correct protective gear where the "effective head size" to be accommodated is larger in one situation than the other, or of having sufficient time to make necessary internal helmet-suspension adjustments as required.

The present invention solves this dilemma. It does so by offering a "stretchable", size-adjustable (stretch-adjustable), cushioning, safety-support structure (a helmet insert), which needs only once to be installed properly in a helmet of the type discussed above, after which time it will always place the recipient helmet in an adaptive condition—a self-adaptive condition—to deal, for example, with the kind of mask/no-mask situation described above, as well as with related situations.

According to a preferred embodiment of the invention, the novel insert thereof takes the form of a domed cap formed of an appropriate, thin, reversibly stretchable fabric, to the inside of which are fastened plural, spaced, position-specific shock-cushioning, compression-responsive pads which are adapted to contact a wearer's head at selected contact locations, or defined regions. The pads are preferably formed of high-capability shock-absorbing assemblies of materials, such as those described in U.S. Pat. No. 6,467,099 B2, issued Oct. 22, 2002, for "Body-Contact Cushioning Interface Structure". The entirety of that issued patent is hereby incorporated by reference into this disclosure to describe a cushioning structure which is ideally suited for employment in this invention. Despite this specific, illustrative incorporation herein, one will recognize that the particular construction of a cushioning pad for use in the present invention is not critical, and does not form any part of the invention.

An insert made in accordance with the present invention is preferably installed in such a helmet shell in any suitable manner that enables it to expand as required within that shell to receive "different-size" heads. A user, such as a fire-fighter, not wearing an oxygen mask, will fit the relevant helmet in place causing preferably just a slight amount stretching and expanding of the fabric cap. The cushioning pads in the cap will bear appropriately against the head at the predetermined contact locations, and the helmet will function well and comfortably. For illustration purposes, a preferred embodiment of the invention is described and illustrated herein installed through conventional hook-and-pile (Velcro®) fastening structure (in the form of confronting, interengaged patches) to the inside of the usual suspension structure provided in a helmet shell of the type generally discussed herein. Slight reversible compressibility of these patches accommodates expansion and contraction of the invention insert as required.

If the use occasion is one requiring that the fire-fighter also wear an oxygen mask, the effective "head enlargement" resulting from this will automatically be accommodated inside the helmet by the occurrence of an appropriate amount of reversible "additional" stretching in the cap. This stretching will not affect the load-cushioning abilities of the pads, since the tension build-up in the cap due to stretching, in accordance with the invention, will effectively be substantially independent of compression in the pads, and thus will not in any noticeable way compromise pad cushioning by "thinning" of the pads due to lateral stretching. Inasmuch as the independent and spaced pads "float" somewhat like islands inside the cap, as the cap expands and contracts (stretches and relaxes), neighboring pads will slightly retreat from and advance toward one another, respectively, and will tend to stay properly positioned relative to the "underlying" head anatomy of a wearer—mask or no-mask.

These and other features and advantage which are offered by the invention will become more fully apparent as the description which now follows is read in conjunction with the accompanying drawings.

In all of these drawing figures, components illustrated are neither necessarily drawn to scale, nor shown in exact proportions relative to one another.

DETAILED DESCRIPTION OF THE INVENTION

Figure 1:
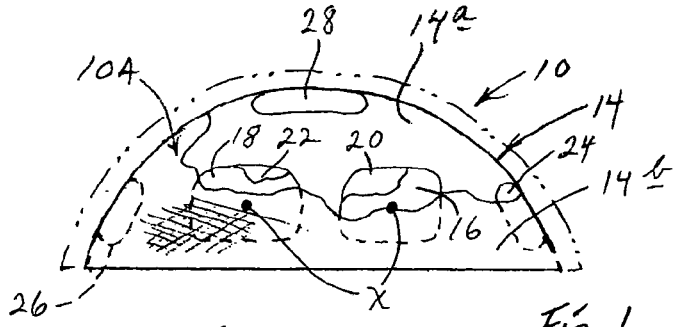
FIG. 1 is a side elevation of a preferred embodiment of a stretch-adaptable cushioning helmet insert made in accordance with the present invention. A portion of the insert has been broken away to show details of construction.
Figure 2:
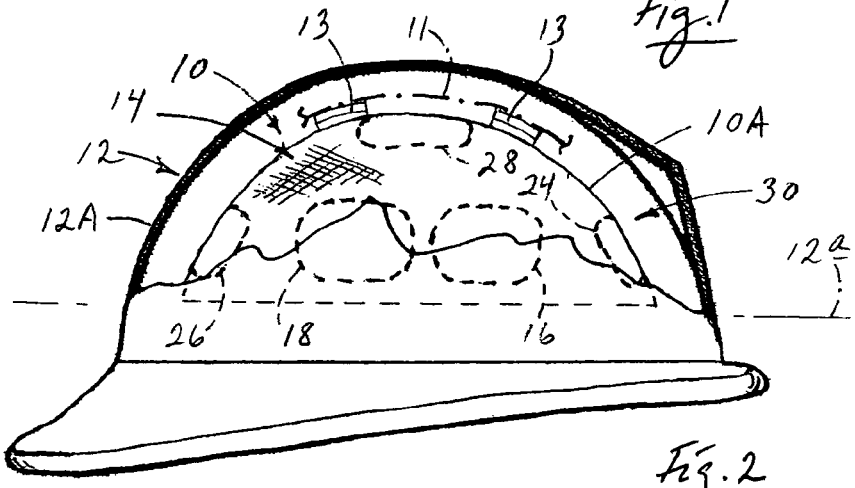
FIG. 2 is a side elevation showing the insert of FIG. 1 installed in a military fire-fighting helmet, with a portion of the shell in the helmet broken away better to illustrate, generally, mounting of the insert to the suspension structure which is installed in the shell.

Turning now to the drawings, indicated generally at 10 is a preferred embodiment of a stretch-adjustable cushioning helmet insert made in accordance with the invention. In FIG. 1, insert 10 is shown isolated from other structure. In FIG. 2, the insert is shown installed in operative condition in a military fire-fighting helmet 12. As will be more fully discussed shortly, the outer side 10A of insert 10 is attached to the conventional suspension structure 11 (fragmentary dash-dot line) in the shell 12A of the helmet through interengaged hook-and-pile fastening structure, like the two such structures which are shown at 13. A typical hook-and-pile fastening structure is sold under the trademark Velcro®.

Insert 10 includes a domed cap 14 having a concave and convex inside and outside surfaces, or faces, 14*a*, 14*b*, respectively, and which is formed of a suitable reversibly stretchable fabric material, such as a Nomex® or Kevlar® material, blended with, for example, Lycra®. Cap 14, which is also referred to herein as a tensioning structure, is "biased", because of its stretchability nature, toward the state in which it is shown in FIG. 1. This state is referred to herein as a size-contracted state. When the cap is stretched, and then "relaxed", it tends to return to the condition shown for it in FIG. 1. The inside surface of the cap is also referred to herein as the cap's "one" face.

Also included in insert 10, and attached as by stitching to the cap's inside surface, is cushioning structure which is made up herein of a plurality of independent, spaced (but neighboring), compression-responsive cushioning pads, such as the seven such pads shown a 16, 18, 20, 22, 24, 26, 28. In accordance with what is referred to herein as a defined-orientation adaptation, insert 10 is designed to assume, within a helmet shell such as shell 12A, a disposition wherein (a) pads 16, 18, 20, 22 are disposed in side-by-side pairs on the opposite lateral sides of the cap, (b) pads 24, 26 are disposed at the front and the rear of the cap, respectively, and (c) pad 28 is positioned generally centrally at the inside top of the cap. Preferably, each of these pads is made in accordance with the teachings of above-mentioned U.S. Pat. No. 6,467,099 B2. Preferably also, each pad is attached to the cap via generally "centralized" stitching at locations like those indicated by "X" for pads 16, 18 in FIGS. 1 and 4.

Figure 4:
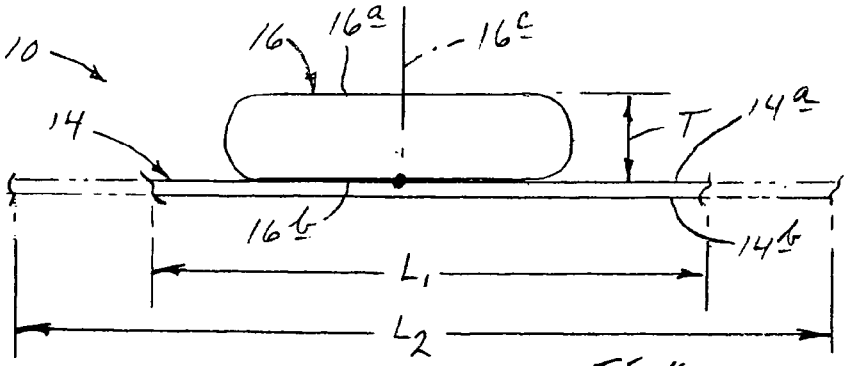

Directing attention for a moment, to FIG. 4 in the drawings which illustrates representative pad 16, along with a fragment of cap 14, each pad has a pair of broad, substantially parallel and somewhat planar, spaced opposite sides, such as sides 16*a*, 16*b*, which define a pad thickness, or a defined depth dimension, T which might typically be about ½-inches. With respect to these opposite sides, each pad has what is referred to herein as a compression axis, such as axis 16*c* for pad 16. Axis 16*c* is substantially normal to the nominal "planes" of sides 16*a*, 16*b*.

With regard to the desired relationship between insert 10 and helmet 12, and recognizing that there is a range of helmet sizes regarding which inserts made in accordance with the present invention should be available, I have found that just a few differently sized inserts will suffice to work well with a larger range of helmet sizes. Specifically, the nominal size-contracted state of an insert should preferably be small enough to fit freely into a helmet shell, and be suitably attachable to internal helmet suspension structure (not part of the invention), with the outside surface of the insert spaced from the inside surface of the helmet shell to provide a suitable "all-around, all-over" clearance/expansion-permitting space, which might typically be in the range of about ½- to about 1-inches. This is the condition illustrated in FIG. 2 where the clearance/expansion space is designated 30.

Preferably the insert is sized in a manner whereby when the helmet user puts on the helmet, without also wearing an oxygen mask or the like, fitting of the helmet with insert on the head involves just a slight amount of insert stretching and expansion, so that the cushioning pads apply slight pressure to the head. The cushioning pads are preferably positioned to engage the head at selected locations (also called defined regions), and the selection of these locations is not part of the present invention. Outside of the invention also is the choice about how many pads to use, and how to shape and size them. Whatever these determinations are regarding pad shape, sizing and placement, it should be the case that when the insert is installed in what is referred to as a defined orientation, the pads will engage the head generally at the desired locations. The defined orientation of insert 10 in helmet 12 is one wherein pads 24, 26 are substantially centered on the fore-and-aft axis 12*a* of the helmet, with pad 24 being disposed toward the front of the helmet.

Figure 3:
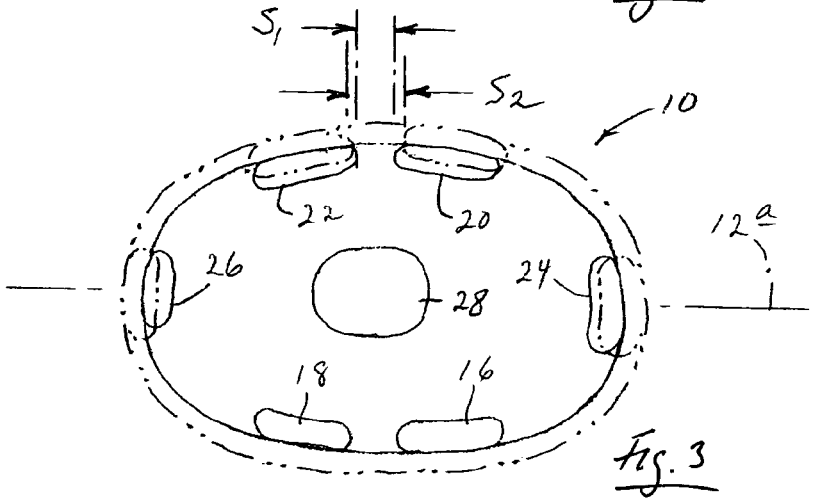
FIGS. 3 and 4 isolate the insert of FIGS. 1 and 2, and together with FIG. 1, illustrate expansion and contraction behavior of the insert.

With regard, then, to a properly sized and installed insert, the insert, because of the reversible stretchability which is offered by cap 14, will expand appropriately in such a helmet to accommodate a situation where the wearer is also wearing a mask, or the like. Dashed lines in FIGS. 1 and 3, in a very exaggerated way, illustrate this accommodation behavior, wherein one will note that, due to stretching in cap 14, the cushioning pads effectively retreat (spatial retreat) from one another, i.e., the spaces between them increase (see the change between $S_1$ (close) and $S_2$ (further apart) shown in FIG. 3). The pads, nonetheless, effectively stay substantially properly "positioned" relative to the respective regions of the head which they are intended to contact. When the helmet is removed after use in this just-described situation, the cap "shrinks", and the pads "close toward" one another (spatial closure).

An interesting feature of the invention which displays itself during such expansion and contraction of cap 14 is that, because of the attached way in which the cap and pads interrelate with one another, lateral stretching of the cap produces no appreciable lateral stretching of the pads. Tension in the cap occurs along lines which are orthogonal relative to the compression axes of the pads. As a consequence, pad thickness T remains substantially constant, and a pad's ability to handle shock loads delivered to a helmet is not compromised. FIG. 4 illustrates this behavior by illustrating pad configuration for pad 16 before stretching of attached cap 14 (solid lines), and pad configuration after such stretching (dash-double-dot lines for the cap). More particularly, in FIG. 4 a small, fragmentary region of cap 14 is illustrated in solid lines with a lateral dimension (left-to-right in this figure) of $L_1$, and in dash-double-dot lines in an exaggerated, laterally stretched condition with a lateral dimension of $L_2$. With respect to pad 16, one can see that this pad experiences no appreciable dimensional change. Specifically, there is almost no detectable shrinking of dimension T (i.e., thinning of pad 16) along axis 16*c*. Thus, lateral stretching/shrinking and expanding/contracting behavior in cap 14 is substantially independent of dimensional change in pad 16, and this situation results in pad 16 offering a substantially unaffected cushioning capability regardless of the stretched condition of cap 14. Another way of thinking about this behavior is to describe insert 10 as being capable of substantially independent responses to loads which cause tensioning of the cap and those which cause compression in the attached cushioning pads.

Thus a novel size-adaptable safety cushioning insert for use inside of the shell of a helmet is provided by the invention. Once properly sized and installed within such a shell, as described above, it readily accommodates the kinds of differentiated "effective" head sizes (for example, differences which exist in the different conditions of a user wearing, or not wearing, an oxygen mask) which are introduced into the shell. The insert is simple and inexpensive, and is easily installed in a helmet shell either as a part of "original helmet construction", or as a retrofit device.

While a preferred embodiment of the invention has been illustrated and described, it is appreciated that variations and modifications may be made without departing from the spirit of the invention.

I claim:

1. A stretchable-adjustable, cushioning helmet insert employable in the hollow, domed interior of a selected-size helmet shell, said insert comprising a generally domed cap adapted for installation within such a shell interior, and formed of a reversibly stretchable fabric, by way of which the cap is biased toward a nominally size-contracted state in which it possesses a size that allows it to be freely placed and received within the hollow, domed interior of such a shell in a manner wherein these exists a defined, surrounding expansion space between the outside of the cap and the inside of the shell allowing for a defined amount of reversible outward expansion of the cap within the shell, and cushioning structure in the form of plural, spaced cushioning pads positionally affixed to said cap on the inside thereof in a manner whereby expansion and contraction of the cap causes spatial retreat and closure, respectively, of the spacings existing between each pad and its neighboring pads.

2. The helmet insert of claim 1, wherein the adaptation of said cap for installation in a shell is one which is characterized as a defined-orientation adaptation.

3. The helmet insert of claim 1, wherein said pads are positioned relative to said cap in a manner whereby they are respectively disposed inside a helmet shell to engage defined regions on the head of a user.

* * * * *